US005083010A

United States Patent [19]

Henry et al.

[11] Patent Number: 5,083,010

[45] Date of Patent: Jan. 21, 1992

[54] PYROLYTIC SELF-CLEANING STOVE

[75] Inventors: Karlheinz Henry, Trostberg; Josef Gerl, Palling, both of Fed. Rep. of Germany

[73] Assignee: Bosch-Siemens Hausgeräte GmbH, Munich, Fed. Rep. of Germany

[21] Appl. No.: 706,296

[22] Filed: May 28, 1991

[30] Foreign Application Priority Data

May 31, 1990 [DE] Fed. Rep. of Germany ..... 4017628

[51] Int. Cl.[5] ..... F27D 11/02; H05B 1/02

[52] U.S. Cl. ..... 219/413; 219/493; 392/378

[58] Field of Search ..... 219/413, 412, 393, 396, 219/398, 492, 493

[56] References Cited

U.S. PATENT DOCUMENTS

| | | | |
|---|---|---|---|
| 3,736,407 | 5/1973 | Leach | 219/492 |
| 3,752,954 | 8/1973 | Holtkamp | 219/413 |
| 3,806,700 | 4/1974 | Gilliom | 219/413 |
| 3,875,372 | 4/1975 | Gilliom | 219/413 |
| 3,899,656 | 8/1975 | Smith | 219/413 |
| 3,962,561 | 6/1976 | Maitenaz | 219/393 |
| 4,071,739 | 1/1978 | Jenn | 219/393 |
| 4,554,437 | 11/1985 | Wagner | 219/411 |

*Primary Examiner*—Teresa J. Walberg

*Attorney, Agent, or Firm*—Herbert L. Lerner; Laurence A. Greenberg

[57] ABSTRACT

A stove with pyrolytic self-cleaning includes an oven having a cooking chamber to be heated and pyrolytically self-cleaned. An automatic pyrolysis system recognizes a limit value for soiling and controls pyrolytic self-cleaning. The automatic pyrolysis system includes a limit value comparator and a pyrolysis trigger connected to the limit value comparator.

14 Claims, 2 Drawing Sheets

PYROLYTIC SELF-CLEANING STOVE

Figure 1:
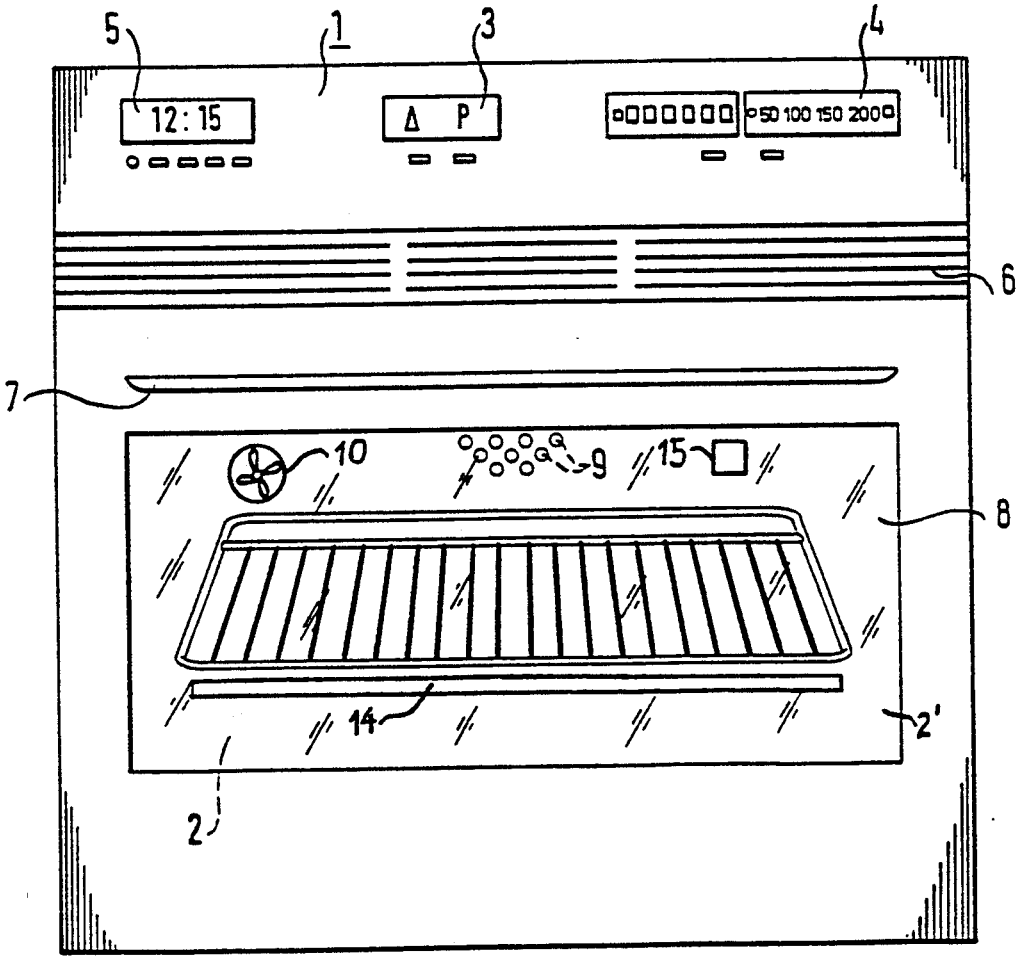

The invention relates to a stove with pyrolytic self-cleaning, having a muffle to be operated with a heating element disposed in at least one wall region and optionally with additional convection heating, a convection blower for venting the muffle, and means for pyrolytic self-cleaning.

The possibility of preventing soiling of a cooking chamber with the aid of pyrolytic self-cleaning, or of eliminating such soiling, is quite well known. Heretofore, the decision to initiate the pyrolytic cleaning process was left to the operator, for instance a housewife. The result was variable cleaning cycles.

It is accordingly an object of the invention to provide a pyrolytic self-cleaning oven, which overcomes the hereinafore-mentioned disadvantages of the heretofore-known devices of this general type and which creates an objectively grounded initiation of pyrolytic cleaning operations.

With the foregoing and other objects in view there is provided, in accordance with the invention, a stove with pyrolytic self-cleaning, comprising an oven having a cooking chamber to be heated, means for pyrolytically self-cleaning the cooking chamber, and an automatic pyrolysis system for recognizing a limit value for soiling and controlling pyrolytic self-cleaning, the automatic pyrolysis system including a limit value comparator and a pyrolysis trigger connected to the limit value comparator.

In accordance with another feature of the invention, there is provided a sensor system being disposed in the cooking chamber and connected to the limit value comparator, the limit value comparator including a register and means for entering operationally dictated oven soiling values from the sensor system in the register, for comparing the oven soiling values with a limit value for oven soiling, and for activating the pyrolysis trigger if the limit value is exceeded.

Through the use of the apparatus according to the invention, the operation of cleaning the oven muffle is recommended by the appliance itself, if the soiling is extensive enough. Soiling of the oven muffle can be detected by suitable sensors which, for instance, evaluate the electrical conductivity, or other systems which, for instance, make decisions with the aid of ultrasound, and process them.

In accordance with a further feature of the invention, the limit value comparator includes a register and means for forming an actual value for oven soiling based on type and frequency of use of oven functions, for entering the actual value into the register, for comparing the actual value with a limit value for oven soiling, and for activating the pyrolysis trigger if the limit value is exceeded. It is therefore seen that another possibility for detecting soiling values for the oven muffle is to use a time and use-dependent system for the particular stove.

In accordance with an added feature of the invention, the pyrolysis trigger activated by the limit value comparator trips pyrolytic self-cleaning.

In accordance with an additional feature of the invention, there is provided a pyrolysis indicator with which the pyrolysis trigger visually signals pyrolytic self-cleaning.

In accordance with yet another feature of the invention, there is provided a pyrolysis indicator with which the pyrolysis trigger audibly signals pyrolytic self-cleaning.

In accordance with yet a further feature of the invention, there is provided a heating trigger being enabled by the pyrolysis trigger for pyrolytic self-cleaning following an acknowledgement signal.

In accordance with yet an added feature of the invention, there is provided a heating trigger, the pyrolytic trigger compelling pyrolytic self-cleaning and enabling the heating trigger for pyrolytic self-cleaning.

In accordance with yet an additional feature of the invention, there are provided means for permitting an operator to erase the register adding up the soiling values.

In accordance with again another feature of the invention, there are provided means for tripping pyrolytic self-cleaning with a compulsory start.

With the objects of the invention in view, there is also provided a stove with pyrolytic self-cleaning, comprising an oven, a muffle disposed in the oven having at least one wall region defining a cooking chamber, a heating element disposed in the at least one wall region for heating the cooking chamber, means for pyrolytically self-cleaning the cooking chamber, and an automatic pyrolysis system for recognizing a limit value for soiling and controlling pyrolytic self-cleaning, the automatic pyrolysis system including a limit value comparator and a pyrolysis trigger connected to the limit value comparator.

In accordance with a concomitant feature of the invention, there are provided means for convection heating the cooking chamber, and a convection blower for venting the muffle.

Other features which are considered as characteristic for the invention are set forth in the appended claims.

Although the invention is illustrated and described herein as embodied in a pyrolytic self-cleaning stove, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
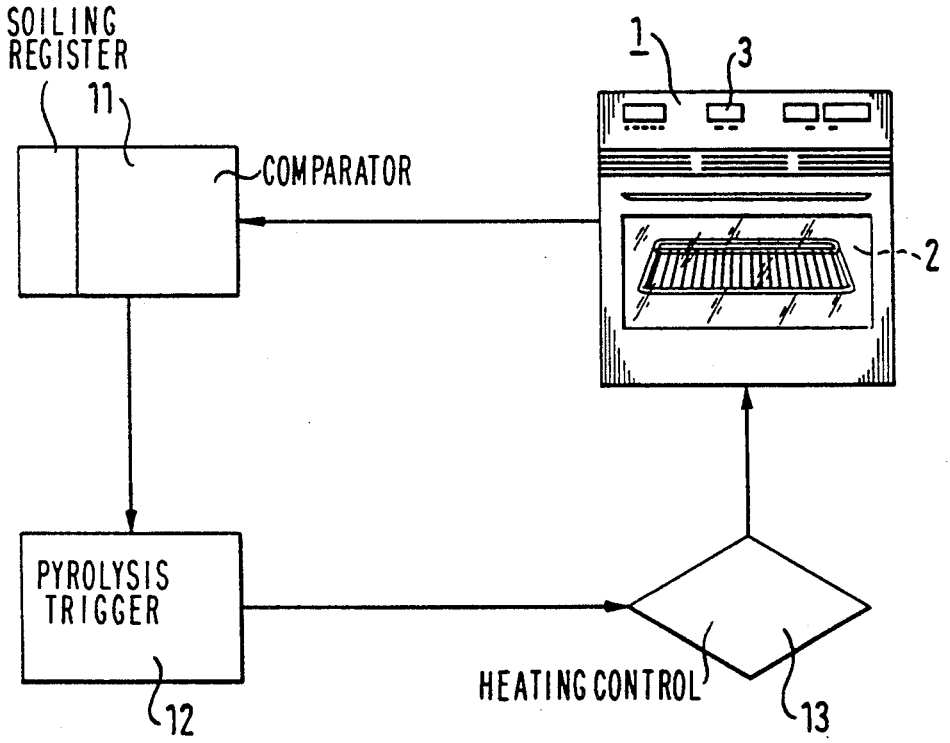

FIG. 1 is a diagrammatic, front-elevational view of a stove with pyrolytic self-cleaning; and FIG. 2 is a similar view of the stove with pyrolytic self-cleaning on a reduced scale, along with a schematic and block circuit diagram of a control loop therefor.

Referring now to the figures of the drawing in detail and first, particularly, to FIG. 1 thereof, there is seen a stove 1 equipped with pyrolytic self-cleaning, having a cooking chamber 2, a pyrolysis indicator 3, controls 4, an electrical input control and stove control means 5, an air expulsion device 6, a door handle 7, a window 8, and a pattern of holes 9 located in the cooking chamber 2 for convection heating. The cooking chamber 2 is located inside a muffle 2' and can be heated by means of a heating element 14 disposed in at least one wall region of the muffle 2'. The cooking chamber 2 can be optionally heated with additional convection heating through the use of the holes 9, while the muffle 2' is vented by a convection blower 10.

A schematic control loop for the pyrolytic self-cleaning is shown in FIG. 2. The stove 1 with pyrolytic self-cleaning which is equipped with the pyrolysis indicator 3, has an optional sensor system 15 in the cooking chamber 2. A limit value comparator 11 with a soiling register 11' receives operationally dictated oven soiling values from the sensor system 15 disposed in the cooking chamber 2. The limit value comparator 11 compares these values with an oven soiling limit value, and if the limit value is exceeded, a pyrolysis trigger 12 is activated, which in turn enables a heating control 13 for pyrolytic self-cleaning, so that the pyrolytic self-cleaning can be initiated. If the limit value comparator 11 has determined that the limit value has been exceeded, then a visual and/or audible signal is provided by the pyrolysis indicator 3. Controls for the pyrolysis indicator 3 make it possible to erase the indication, which is optionally associated with resetting of the limit value comparator register 11', or to initiate pyrolysis immediately.

If the cooking chamber 2 has no sensor system capable of detecting oven soiling, then an option exists for the limit value comparator 11 to form an actual value for oven soiling from the type and frequency of use of the oven functions, to enter this value into the soiling register 11' for the limit value comparator, to compare it with a limit value for oven soiling, and to activate the pyrolysis trigger 12 if this limit value is exceeded. The pyrolysis trigger 12 which is activated by the limit value comparator 11, trips or signals the pyrolytic self-cleaning. The pyrolytic self-cleaning can be signaled visually or audibly by means of the pyrolysis indicator 3. Following an acknowledgement signal, the pyrolysis trigger 12 enables the heating control 13, so that the pyrolysis operation in the cooking chamber can begin. A pyrolytic self-cleaning can also be compelled after repeated acknowledgements, by means of the pyrolysis trigger 12. The soiling values provided to the limit value comparator 11 by the sensor system 15 or by adding up time values, are added up in the limit value comparator register 11'. If the comparison with the limit value comparison register 11' and a memorized soiling limit value shows that the limit value has been exceeded, and if the operator wishes to postpone the pyrolytic self-cleaning, then the soiling values added up in the limit value comparator register 11' can be erased or reduced, by means of an erase signal. A compulsory start of the pyrolytic self-cleaning is equally possible.

We claim:

1. A stove with pyrolytic self-cleaning, comprising an oven having a cooking chamber to be heated, means for pyrolytically self-cleaning said cooking chamber, and an automatic pyrolysis system for recognizing a limit value for soiling and controlling pyrolytic self-cleaning, said automatic pyrolysis system including a limit value comparator and a pyrolysis trigger connected to said limit value comparator.

2. The stove according to claim 1, including a sensor system being disposed in said cooking chamber and connected to said limit value comparator, said limit value comparator including a register and means for entering operationally dictated oven soiling values from said sensor system in said register, for comparing the oven soiling values with a limit value for oven soiling, and for activating said pyrolysis trigger if the limit value is exceeded.

3. The stove according to claim 1, wherein said limit value comparator includes a register and means for forming an actual value for oven soiling based on type and frequency of use of oven functions, for entering the actual value into said register, for comparing the actual value with a limit value for oven soiling, and for activating said pyrolysis trigger if the limit value is exceeded.

4. The stove according to claim 1, wherein said pyrolysis trigger activated by said limit value comparator trips pyrolytic self-cleaning.

5. The stove according to claims 4, including a pyrolysis indicator with which said pyrolysis trigger visually signals pyrolytic self-cleaning.

6. The stove according to claim 4, including a pyrolysis indicator with which said pyrolysis trigger audibly signals pyrolytic self-cleaning.

7. The stove according to claim 4, including a heating trigger being enabled by said pyrolysis trigger for pyrolytic self-cleaning following an acknowledgement signal.

8. The stove according to claim 4, including a heating trigger, said pyrolytic trigger compelling pyrolytic self-cleaning and enabling said heating trigger for pyrolytic self-cleaning.

9. The stove according to claim 2, including means for permitting an operator to erase said register adding up the soiling values.

10. The stove according to claim 3, including means for permitting an operator to erase said register adding up the soiling values.

11. The stove according to claim 9, including means for tripping pyrolytic self-cleaning with a compulsory start.

12. The stove according to claim 10, including means for tripping pyrolytic self-cleaning with a compulsory start.

13. A stove with pyrolytic self-cleaning, comprising an oven, a muffle disposed in said oven having at least one wall region defining a cooking chamber, a heating element disposed in said at least one wall region for heating said cooking chamber, means for pyrolytically self-cleaning said cooking chamber, and an automatic pyrolysis system for recognizing a limit value for soiling and controlling pyrolytic self-cleaning, said automatic pyrolysis system including a limit value comparator and a pyrolysis trigger connected to said limit value comparator.

14. The stove according to claim 13, including means for convection heating said cooking chamber, and a convection blower for venting said muffle.

* * * * *